United States Patent [19]

Wilhelmi et al.

[11] 4,266,882

[45] May 12, 1981

[54] TABLE SECTION ALIGNING AND FASTENING DEVICE

[76] Inventors: Julius B. Wilhelmi, 38 Merrill Rd., Hull, Mass. 02045; Bert O. Anderson, 18 Maugus Ave., Wellesley, Mass. 02181

[21] Appl. No.: 952,744

[22] Filed: Oct. 19, 1978

[51] Int. Cl.[2] ..... F16B 12/00

[52] U.S. Cl. ..... 403/14; 403/407; 108/83

[58] Field of Search ..... 108/83, 89; 403/407, 403/406, 329, 330, 13, 14; 292/303, 76, 87, DIG. 39, DIG. 40

[56] References Cited

U.S. PATENT DOCUMENTS

| | | | |
|---|---|---|---|
| 1,654,163 | 12/1927 | Evans | 292/1 Q |
| 3,202,117 | 8/1965 | Zimmerman | 108/89 |
| 3,313,510 | 4/1967 | Mudano | 108/83 UX |
| 3,466,075 | 9/1969 | Fernandez et al. | 292/76 X |
| 3,515,077 | 6/1970 | Glowacki | 108/89 |
| 3,820,477 | 6/1974 | Griffin | 108/89 |
| 3,915,100 | 10/1975 | Sullivan | 108/89 X |
| 4,025,216 | 5/1977 | Hives | 403/381 |

*Primary Examiner*—Andrew V. Kundrat

[57] ABSTRACT

A table section aligning and fastening device comprises a unitary plastic male member including a projecting nose portion and a complementary unitary plastic female member defining an alignment channel for receiving the nose portion of the male member. The members mount to the underside of respective table sections to be joined at their respective abutting edges. The nose portion is both laterally and vertically tapered so as to cooperate with the alignment channel defining portion of the female member in guiding the table sections into lateral and vertical alignment as they are pushed together. The female member includes an integral resilient finger which resiliently engages in a retaining notch formed in the nose portion to hold the members and the table sections together.

10 Claims, 9 Drawing Figures

TABLE SECTION ALIGNING AND FASTENING DEVICE

BACKGROUND OF THE INVENTION

This invention relates generally to releasable fasteners and, more particularly, to a releasable fastening and aligning device for joinable table sections or the like.

Table structures are known that can be joined together or that can receive removable table leaves when the effective surface area of the table is to be increased. In such structures, means are typically provided for aligning the joinable table sections relative to one another and for maintaining that alignment during use. Ideally, any such alignment means should be capable of aligning the table sections both vertically and laterally, should be easy to engage when the sections are to be joined together, and should be easy to release when the sections are to be separated. Additionally, the alignment means should be capable of holding the sections together with sufficient strength to prevent the accidental separation of the sections when the table is moved.

In one commonly used arrangement, one of the table sections is equipped with projecting pins, while the abutting surface of the other table section is equipped with corresponding holes adapted to receive the pins. Provided the pins and holes are properly located during the manufacture of the table, the pins engage within their corresponding holes to bring and maintain the abutting table sections in vertical and lateral alignment. Usually, one or more locks or other fastening devices are included to hold the table sections together.

The pin and hole arrangement is disadvantageous because it typically requires the use of relatively costly drilling and aligning methods for its manufacture. The arrangement is further disadvantaged by the need for separate locks or other fastening devices for holding the table sections together, which devices are often difficult to engage and release.

Various other arrangements and devices have been proposed for aligning and securing joinable table sections together. See, for example, U.S. Pat. Nos. 3,202,117; 3,313,510; 3,515,077; 3,820,477; and 3,915,100. The device shown in U.S. Pat. No. 3,202,117 is capable of aligning joinable table sections only laterally, and relies upon other structure to assure that there is no relative vertical displacement of the sections. The device shown in U.S. Pat. No. 3,313,510 provides both lateral and vertical alignment, but includes no means for holding the table sections together. The devices shown in the latter three patents are of rather complex construction, being relatively difficult to install and operate and expensive to produce.

OBJECTS OF THE INVENTION

Accordingly, a broad object of the present invention is to provide improved means for aligning joinable table sections or the like relative to one another.

Another object of the invention is to provide an improved table section aligning device that is capable of aligning table sections both vertically and laterally.

Another object of the invention is to provide an improved table section aligning device that also serves as a fastening device to hold the table sections together.

Another object of the invention is to provide an improved table section aligning and fastening device of the type described that can be engaged with relative ease simply by pushing the table sections together, that, when engaged, holds the table sections together with sufficient strength to enable the table to be moved about without the disengagement of the device, and that can be released when desired also with relative ease by sharply pulling or jerking of the table sections apart.

Still another object of the invention is to provide an improved table section aligning and fastening device of the type described that is relatively simple in construction and economical to produce.

Other objects will, in part, be obvious and will, in part, appear hereinafter.

SUMMARY OF THE INVENTION

In accordance with an illustrative embodiment of the invention, a combined aligning and fastening device comprises a male member which mounts to the underside of a first joinable table section at its abutting edge, and a complementary female member which mounts to the underside of a second table section at its abutting edge. The male member includes a base portion having a leading edge that is aligned with the abutting edge of the table section during mounting and openings for receiving screws or other suitable means to secure the member in place. A nose portion projects outwardly from the leading edge of the base portion of the male member. The nose portion has essentially flat and straight side surfaces near the leading edge of the base portion, while the free or projecting end of the nose portion is tapered in cross-section both laterally and vertically to a rounded point. A "V" shaped retaining notch is formed at an intermediate position in the lower surface of the nose portion (i.e., the surface thereof that is spaced away from the underside of the table section when the male member is mounted).

The female member also includes a base portion having a leading edge that is aligned with the abutting edge of the second table section during mounting and openings through which screws may be passed to secure the female member in place. A central, channel defining portion defines an alignment channel having an entrance opening at the leading edge of the female member which is adapted to receive the nose portion of the male member when the two table sections are abutted. The edges of the channel defining portion defining the entrance opening are preferably beveled so as to cooperate with the tapers in the nose portion of the male member to move or guide the two table sections into lateral and vertical alignment as they are pushed together.

The female member also includes a male member gripping portion in the form of an integral finger which is formed within an elongated slot in the channel defining portion and which extends downwardly from the end of the base portion opposite the entrance opening and then forwardly toward, but only part of the way to, the entrance opening. The free end of the finger is resiliently flexible relative to the channel defining portion and includes an upstanding lip that normally projects into the alignment channel. When the nose portion of the male member is pushed into the alignment channel, the lip bears against the downwardly looking tapered surface on the nose portion and is deflected downwardly until the lip reaches the retaining notch whereupon it resiliently snaps into the notch to hold or clip the male and female members together. The finger, lip and notch are preferably relatively dimensioned such that, when the nose portion is fully within the alignment channel and the leading edges of the male and female members are in facing contact, the upstanding lip does not fully enter the retaining notch and does not fully return to its normal undeflected position, but rather bears against an intermediate portion of the notch defining surface that is closer to the free end of the nose portion. The angle of that surface together with the resiliency of the finger gives rise a reaction force tending to pull the nose portion firmly into the alignment channel and to hold the two table sections together.

The amount of force necessary to push the male fastening member into the female fastening member depends, in part, upon the angle of the downwardly looking nose taper on which the lip of the resilient finger rides. That angle is preferably selected so that the male and female members can be lockingly engaged with a relatively small pushing force. The amount of force necessary to remove the male fastening member from the female fastening member depends, in part, upon the angle of the notch defining surface against which the lip bears in the locked position. That angle is preferably selected such that a considerably greater force is required to remove the male member from the female member. This enables the table to be moved about or pulled around without causing the disengagement of the fastening members. When the table sections are to be separated, a sharp pulling or jerking motion is effective in removing the lip from the retaining notch and in disengaging the fastening members.

The male and female fastening members may each be fabricated as unitary components from a suitable plastic material by conventional molding techniques and, as a result, may be produced economically in large quantities.

BRIEF DESCRIPTION OF THE DRAWING

The foregoing and other objects, features and advantages of the invention will be better understood from the following detailed description taken in conjunction with the accompanying drawing in which.

DESCRIPTION OF AN ILLUSTRATIVE EMBODIMENT

Figure 1:
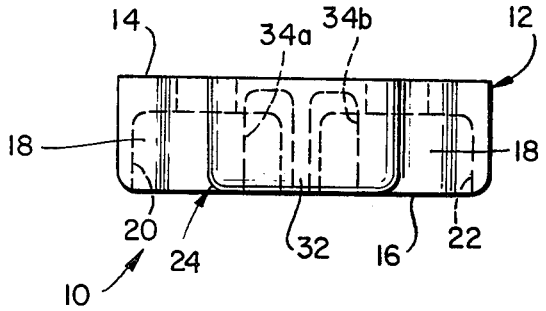
FIG. 1 is an end view of a male table section aligning and fastening member embodying the invention.
Figure 2:
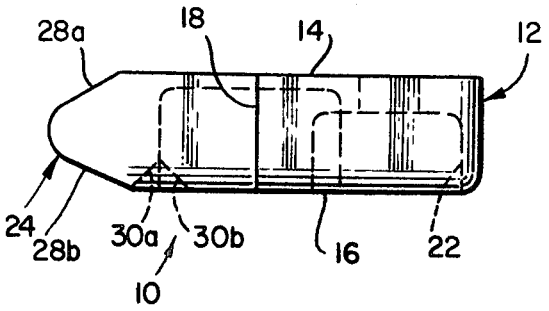
FIG. 2 is a side view of the male aligning and fastening member of FIG. 1.
Figure 3:
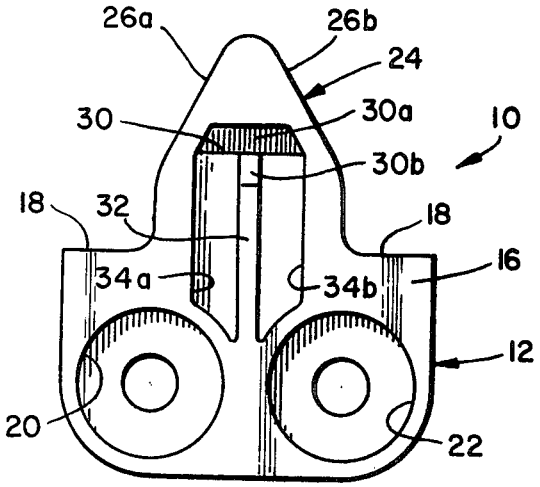
FIG. 3 is a bottom view of the male fastening member of FIG. 1.

Referring now specifically to the drawing, and initially to FIGS. 1 through 3 thereof, there is shown a male table section aligning and fastening member 10 embodying the invention. The member 10 is illustratively formed as a unitary component from plastic and includes a base portion 12 defining a top surface 14 which contacts the underside of a table section when the member 10 is mounted, a bottom surface 16 and a generally flat and straight leading edge 18. A pair of countersunk openings 20 and 22 are provided in the base portion 12 through which screws or other such means may be passed in attaching the member 10 to the table section. When the member 10 is mounted, the heads of the attaching screws are thus shielded in the countersunk openings 20 and 22, thereby to prevent scratching or other damage due to contact with the screw heads.

A nose portion 24 projects outwardly from the leading edge 18 of the base portion 12. As can be appreciated from FIG. 1, the nose portion 24 has a generally rectangular cross-section (i.e., the bottom corners of which are somewhat rounded). For about half of the projecting length of the nose portion 24, the outside surfaces thereof are generally straight and perpendicular to the leading edge 18. Those surfaces, however, taper inwardly toward the free end of the nose portion 24 to define a pair of lateral tapers 26*a* and 26*b* (FIG. 3) and a pair of vertical tapers 28*a* and 28*b* (FIG. 2).

A "V" shaped retaining notch 30 is defined in the bottom surface of the nose portion 24 by a pair of angled surfaces 30*a* and 30*b*, respectively. The surface 30*b* is formed on the forward end of an axial rib or wall 32 that extends downwardly from the top surface 14 and that defines a pair of mirror image recesses 34*a* and 34*b*. As noted, the member 10 is preferably fabricated as a unitary component from plastic with the preferred fabrication technique being a hot injection molding process. The recesses 34*a* and 34*b* serve to reduce the thickness of the component in the vicinity of the nose portion 24 and thus help avoid dimpling of the outside surfaces of the nose portion 24 due to contraction of the plastic upon cooling in the mold.

Figure 4:
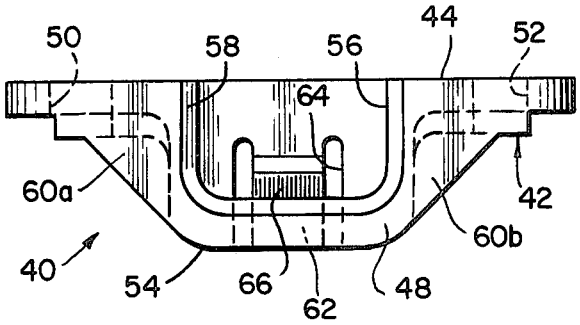
FIG. 4 is an end view of a complementary female table section aligning and fastening member embodying the invention.
Figure 5:
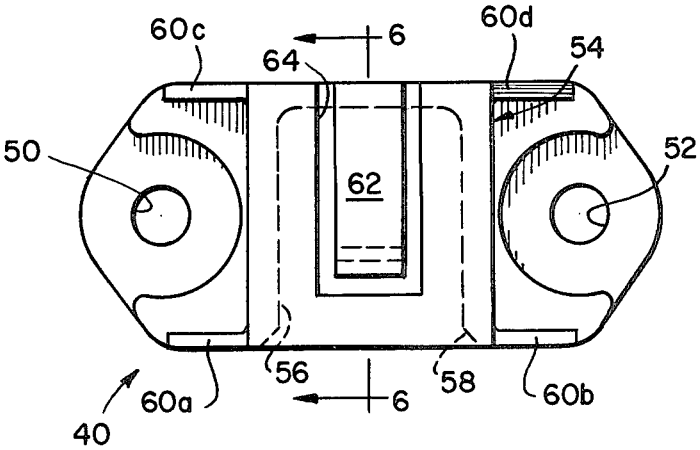
FIG. 5 is a bottom view of the female aligning and fastening member of FIG. 4.
Figure 6:
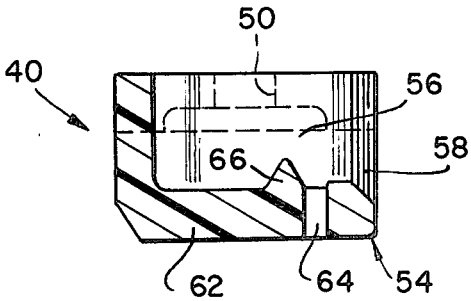
FIG. 6 is a side cross-sectional view of the female aligning and fastening member of FIG. 4 taken along the plane labelled 6—6 in FIG. 4.

FIGS. 4 through 6 show a complementary female table section aligning and fastening member 40 embodying the invention. Like the male member 10, the female member 40 is illustratively a unitary plastic component including a base portion 42 defining a top surface 44 and a leading edge 48. A pair of countersunk openings 50 and 52 are provided through opposite sides of the base portion 42 for receiving screws or other means used to attach the female member 40 to its table section.

Projecting downwardly from the center of the base portion 42 is an alignment channel defining portion 54 which defines an alignment channel 56 having an entrance opening at the leading edge 48. The alignment channel 56 has cross-sectional dimensions slightly greater than those of the male member nose portion 24 so that the latter may be received in the channel 56. An outward bevel 58 is formed around the periphery of the entrance opening of the channel 56. The bevel 58 cooperates with the tapers 26*a*/26*b* and 28*a*/28*b* in the male member nose portion 24 to guide the nose portion 24 into the channel 56.

Integral ribs 60*a*, 60*b*, 60*c* and 60*d* extend from the corners of the channel defining portion 54 to the base portion 42. When the female member 40 is mounted, the ribs 60*a* through 60*d* and the countersunk openings 50 and 52 shield the heads of the screws used to mount the member 40.

The female member 40 includes a male member gripping portion in the form of an integral finger 62 that extends downwardly from the end of the base portion 42 opposite the leading edge 48 and then forwardly toward, but not completely to, the leading edge 48. The finger 62 is disposed within an elongated slot 64 in the channel defining portion 54 so that the lower or bottom surface of the finger 62 is normally parallel to the lower or bottom surface of the channel defining portion 54. Projecting upwardly from the free end of the finger 62 is a tapered lip 66. As best seen in FIG. 6, the lip 66 normally projects upwardly into the alignment channel 56.

As the nose portion 24 of the male member 10 is pushed into the alignment channel 56 of the female member 40, the lip 66 is adapted to bear against and slide along the downwardly looking vertical taper 28*b* on the nose portion 24. The free end of the finger 62 is thus deflected downwardly relative to the channel defining portion 54 as the nose portion 24 enters the channel 56. The finger 62 is, however, resilient and seeks to maintain its normal undeflected position as illustrated in FIG. 6. Thus, when the nose portion 24 is fully within the channel 56, the lip 66 on the end of the finger 62 snaps upwardly into the "V" shaped retaining notch 30 to hold the male and female members 10 and 40, respectively, together.

Figure 7:
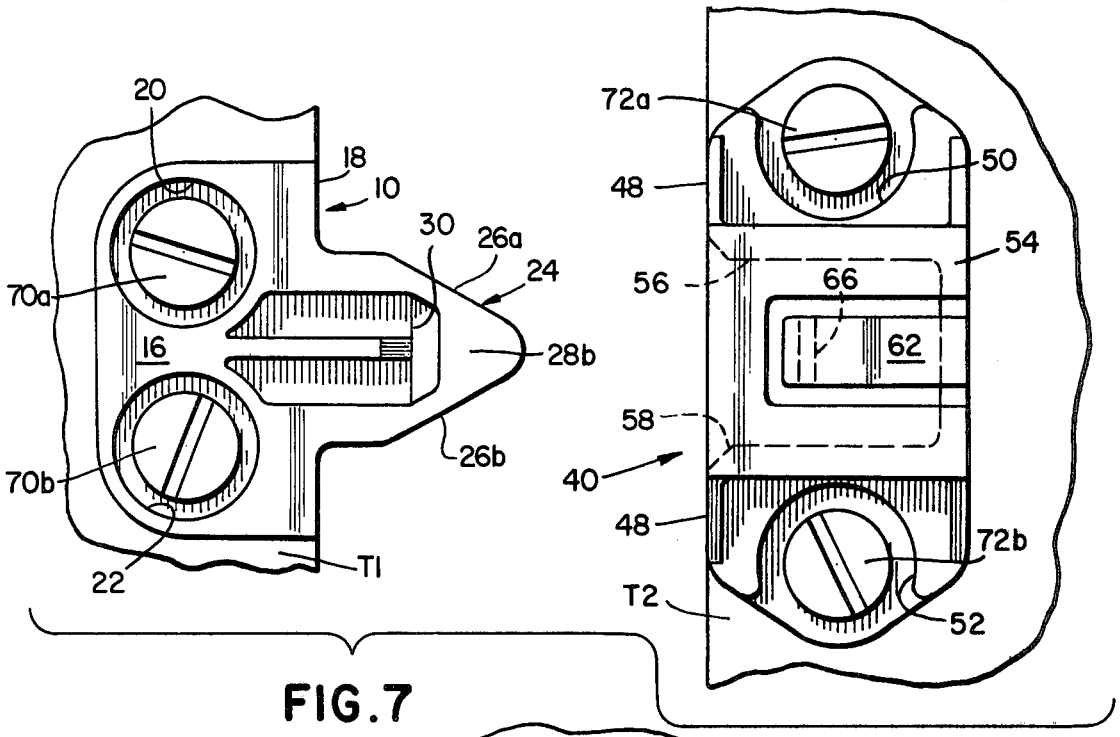
FIG. 7 illustrates the male and female members of FIGS. 1 and 4 secured, respectively, to the underside of a pair of table sections to be aligned and fastened together.

FIG. 7 shows the male member 10 and female member 40 mounted to a pair of table sections T1 and T2, respecthvely, to be aligned and joined together. The view of FIG. 7 is taken from underside of the table sections T1 and T2. The male member 10 is shown mounted to the section T1 with its leading edge 18 aligned with the abutting edge of the section T1. The member 10 is secured in place by a pair of screws 70*a* and 70*b* passed through the openings 20 and 22, respectively, in the base portion 16 of the member 10. The female member 40 is shown mounted at a corresponding location to the table section T2 with its leading edge 48 aligned with the abutting edge of the section T2. A pair of screws 72*a* and 72*b* passed through the openings 50 and 52, respectively, secure the female member 40 in place. Only a small portion of the table sections T1 and T2 are shown in FIG. 7, with each of the sections T1 and T2 typically having considerable width along their abutting edges. As a result, more than one pair of complementary male and female members 10 and 40, respectively, are typically mounted at spaced positions along the abutting edges of the sections T1 and T2.

If the table sections T1 and T2 are out of alignment, either vertically or laterally, as they are pushed together, the tapers 26*a*/26*b* and 28*a*/28*b* in the nose portion 24 will bear against the bevel 58 and/or the lower abutting edge of the section T2. Transverse forces are thereby generated which guide the nose portion 24 into the channel 56 and thus move the sections T1 and T2 into vertical and lateral alignment. With the illustrated design, the table sections T1 and T2 can be out of lateral alignment in either direction by as much as about one half the lateral width of the nose portion 24. Similarly, the sections T1 and T2 can be out of vertical alignment in either direction by as much as about one half the height (FIG. 2) of the nose portion 24.

As the sections T1 and T2 are pushed together and the nose portion 24 enters the channel 56, the lip 66 on the finger 62 bears against and rides along the downwardly looking taper 28*b* of the nose portion 24. The free end of the finger 62 is thus progressively deflected downwardly as the nose portion 24 advances into the channel 56. The amount of force necessary to push the nose portion 24 into the channel 56 depends upon the resiliency of the finger 62 and upon the angle of the taper 28*b*. In a preferred embodiment of the invention, the taper 28*b* is disposed at an angle of about 20° to the bottom surface of the nose portion 24. This allows the table sections T1 and T2 to be joined together with only a relatively small pushing force.

Figure 8:
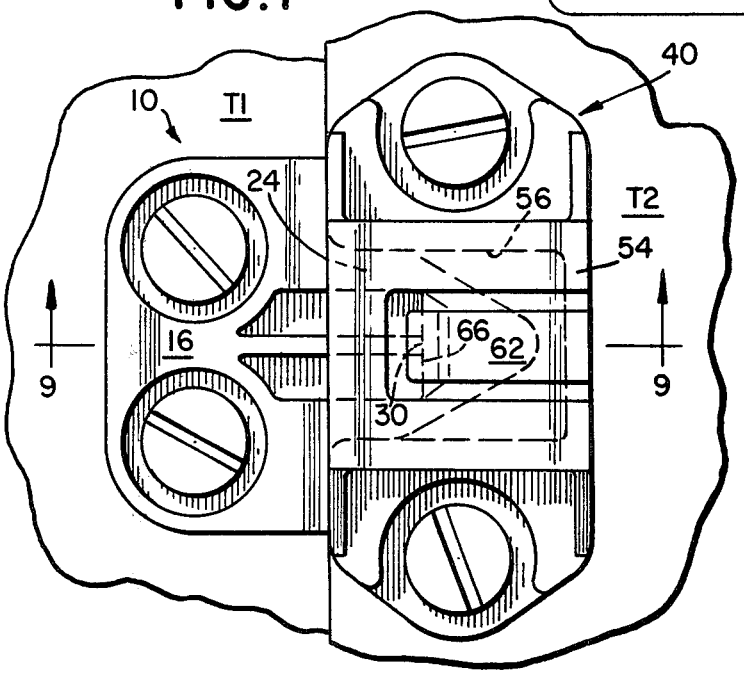
FIG. 8 shows the table sections of FIG. 7 in an edge abutting relationship with the male member engaged and locked within the female member.
Figure 9:
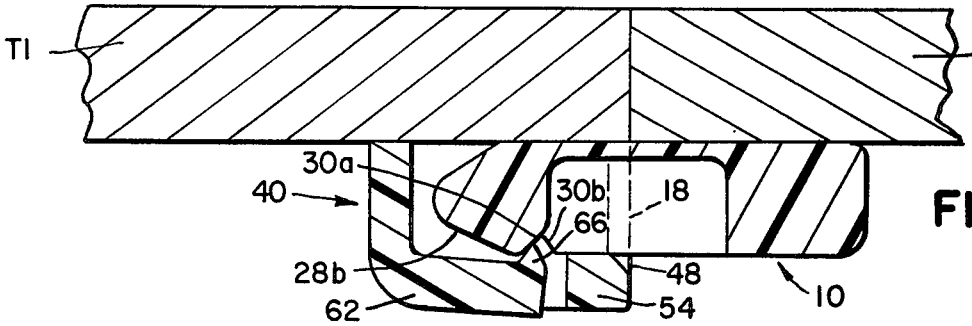
FIG. 9 is a side cross-sectional view of the abutted table sections and engaged members of FIG. 8 taken along the plane labelled 9—9 in FIG. 8.

FIGS. 8 and 9 of the drawing show the table sections T1 and T2 in edge abutting contact with the male member 10 fully engaged within the female member 40. As best seen in FIG. 9, when the leading edges 18 and 48 of the members 10 and 40, respectively, are in contact, the lip 66 on the finger 62 engages in the retaining notch 30 in the nose portion 24 to hold the members 10 and 40 together. The finger 62, lip 66 and notch 30 are preferably dimensioned such that the lip 66 does not fully enter the notch 30, but rather bears against an intermediate portion of the rearwardly looking surface 30*a*. The finger 62 thus remains deflected somewhat below the lower or bottom surface of the channel defining portion 54. The resiliency of the finger 62 together with the angle of the surface 30*a* gives rise to a reaction force tending to pull the nose portion 24 into the channel 56. That force assures that the members 10 and 40, and thus the table sections T1 and T2, remain in edge abutting contact. The overall depth of the surface 30*a* also enables the members 10 and 40 to lockingly engage and to maintain the table sections T1 and T2 in edge abutting contact even though the leading edges 18 and 48, respectively, are not perfectly aligned with the abutting edges of the respective table sections T1 and T2 during mounting.

The force necessary to remove the nose portion 24 from the channel 56 depends upon the resiliency of the finger 62 and upon the angle of the surface 30*a*. Preferably, the angle of the surface 30*a* is selected so that more force is necessary to remove the nose portion 24 from the channel 56 than is necessary to push the nose portion 24 into the channel. This helps to prevent the table sections T1 and T2 from being accidentally separated when the sections are moved about while joined together. In the preferred embodiment of the invention, the surface 30*a* is disposed at an angle of 45° to the lower or bottom surface of the nose portion 24.

As unitary components, the members 10 and 40 can be economically fabricated in large numbers from plastic using conventional molding techniques, such as hot injection molding. Any of a variety of plastic materials may be used for the members 10 and 40 including, for example, nylon and the polyacetal composition available commercially under the trademark Delrin from DuPont.

It should be understood that the foregoing detailed description describes only one specific illustrative embodiment of the invention. Numerous modifications to the disclosed embodiment will be recognized by those skilled in the art which fall within the scope of the invention as defined by the appended claims.

What is claimed as new and desired to be secured by Letters Patent of the United States is:

1. An aligning and fastening device for interconnecting first and second joinable table sections at respective abutting edges thereof, said device comprising:

A. a male member including i. a base portion adapted for mounting to the underside of the first table section at its abutting edge, ii. a nose portion projecting outwardly from one end of said base portion and having a portion including a free end adapted for extending beyond the abutting edge of the first table section when said male member is mounted, iii. said nose portion having a retaining notch disposed at an intermediate position in said nose portion, said notch being defined by first and second angled surfaces formed in the side of said nose portion between the free end thereof and the base portion; and B. a female member including i. a base portion adapted for mounting to the underside of the second table section at its abutting edge, ii. a channel defining portion defining an alignment channel and an entrance opening adapted to receive said nose portion of said male member when said first and second table sections are abutted together and in alignment, and iii. a gripping portion comprising an integral finger projecting toward the entrance opening from the end of said female member base portion opposite the entrance opening and having a free end that is resiliently flexible relative to said channel defining portion and that includes a lip normally projecting into the alignment channel, said lip being deflectable out of the alignment channel as said nose portion of said male member is moved into the alignment channel and being resiliently engagable within said retaining notch to hold said nose portion in the alignment channel.

2. The device of claim 1 in which the free end of said male member nose portion tapers in cross section laterally and vertically to define a pair of laterally tapered surfaces and a pair of vertically tapered surfaces on the free end of said nose portion and wherein said tapered surfaces are adapted to bear against the edges of said female member channel defining portion at the entrance opening if the table sections are out of alignment as said nose portion is moved into the alignment channel thereby to generate transverse forces tending to move the table sections into alignment.

3. The device of claim 2 in which the edge of said female member channel defining portion at the entrance opening is outwardly beveled to cooperate with said tapered surfaces on said nose portion in generating the transverse aligning forces.

4. The device of claim 2 in which said lip on said integral finger of said female member is adapted to bear against and ride along one of said vertically tapered surfaces of said nose portion and thereby to be deflected out of the alignment channel as said nose portion is moved into the alignment channel.

5. The device of claim 4 in which said nose portion defines a generally flat bottom surface and in which said one of said vertically tapered surfaces is disposed at an angle of about 20° to said generally flat bottom surface.

6. The device of claim 1 in which said male member and female member base portions each include means defining openings for receiving means for mounting said members to the respective table sections.

7. The device of claim 1 in which said male and female members are each formed as unitary components from a plastic material.

8. The device of claim 1 in which said notch is generally "V" shaped.

9. The device of claim 1 in which the first of said notch defining surfaces faces toward said male member base portion and in which said lip on said integral finger of said female member is adapted to bear against an intermediate portion of said first notch defining surface when said nose portion is fully within the alignment channel, the angle of said first notch defining surface together with the resiliency of said integral finger serving to generate a reaction force tending to hold said nose portion in the alignment channel.

10. The device of claim 9 in which said nose portion defines a generally flat bottom surface and in which said first notch defining surface is disposed at an angle of about 45° to said bottom surface.

* * * * *